United States Patent [19]

Stankiewicz

[11] 3,958,512

[45] May 25, 1976

[54] RAPID TRANSIT SYSTEM

[76] Inventor: Jerzy G. Stankiewicz, Oberkircherg. 38/1/4, Vienna, Austria, A-1190

[22] Filed: Nov. 5, 1974

[21] Appl. No.: 521,099

Related U.S. Application Data

[63] Continuation-in-part of Ser. No. 277,921, Aug. 4, 1972, Pat. No. 3,847,496, which is a continuation-in-part of Ser. No. 207,372, Dec. 13, 1971, abandoned.

[30] Foreign Application Priority Data

Dec. 11, 1970 Austria ..... 11137/70

[52] U.S. Cl. ..... 104/20

[51] Int. Cl.[2] ..... B61K 1/00

[58] Field of Search ..... 104/18, 20, 135, 162, 104/25, 88

[56] References Cited

UNITED STATES PATENTS

| | | | |
|---|---|---|---|
| 684,693 | 10/1901 | Jenkins | 104/20 |
| 1,383,220 | 6/1921 | Lamar | 104/20 |
| 1,496,550 | 6/1924 | Lamar | 104/20 |
| 3,190,477 | 6/1965 | Ewers | 104/18 X |
| 3,219,218 | 11/1965 | Hand | 104/162 X |
| 3,734,025 | 5/1973 | Shoemaker | 104/18 X |
| 3,791,304 | 2/1974 | Bardet et al. | 104/18 |
| 3,823,671 | 7/1974 | Straumsnes | 104/20 X |

*Primary Examiner*—Frank E. Werner
*Assistant Examiner*—Randolph A. Reese
*Attorney, Agent, or Firm*—Karl F. Ross; Herbert Dubno

[57] ABSTRACT

Two central railroad tracks, carrying express trains in opposite directions, are flanked at a station by respective pairs of lateral tracks accommodating shuttle trains for the loading and unloading, respectively, of the associated express trains. The shuttle trains accelerate from standstill, upon the approach of the express train, to the speed of the latter and, on pulling abreast with the express train, dock with it to facilitate the transfer of passengers and freight from the loading shuttle to the express and from the express to the unloading shuttle. The freight compartments of the trains have lateral door sections which, for docking as well as loading and unloading, can be swung down and up to form bridges with guidetracks and overhead bearing surfaces for roller-mounted transporters which are pneumatically shifted across these bridges.

10 Claims, 6 Drawing Figures

294
13'
292
14'
297
16
21
292
20
19
18
13
296
14
290
17
VI
22
16
23
290
19
18
14
13
Z
25a
21
291
15
VI
12
17
23
11
25b
12
295
16
14'
291
10
13'
293

296
11
22
22
11
17
21
23
14
14
24
11'
11'
13
16
21
22
16
17
295
11
23
24
11

RAPID TRANSIT SYSTEM

CROSS-REFERENCE TO RELATED APPLICATION

This application is a continuation-in-part of my copending application Ser. No. 277,921 filed Aug. 4, 1972, now U.S. Pat. No. 3,847,496 which is a continuation-in-part of application Ser. No. 207,372, filed Dec. 13, 1971, now abandoned.

FIELD OF THE INVENTION

My present invention relates to a rapid-transit system in which a number of stations are interconnected by a rail line or link, or by a pair of such rail links carrying traffic in opposite directions, each rail link preferably forming a closed loop along which a train or other carrier may circulate unidirectionally past all the stations on its route. Such rapid-transit systems are particularly suitable for urban settlements.

BACKGROUND OF THE INVENTION

Conventional railborne freight or passenger carriers waste both time and energy in stopping and restarting at stations for the loading and unloading of people and/or goods. Since most of the load of a train generally remains on board for a number of track sections linking successive stations, the masses to be accelerated and decelerated are often considerably larger than those taken on or to be discharged at any one station.

In my copending application and patent identified above, I have disclosed a rapid-transit system with three parallel tracks including a central track and two lateral tracks, the central track accommodating a continuously running carrier or express train in the form of an endless chain of cars or conveyor sections while the lateral tracks are used by intermittently moving local carriers or shuttle trains of simpler construction. One of the shuttle trains is accessible from a loading platform of a station where it can be boarded by waiting passengers and from which it accelerates to the speed of the express train on the adjoining central track. As soon as it reaches that speed, the two trains dock and the passengers can enter the express train to continue their ride until they approach their destination. At that point the second shuttle train, moving on the other lateral track at the speed of the express train, docks with it to let the exiting passengers transfer to that shuttle train which subsequently stops at an unloading platform of the next station, allowing the passengers to get off.

OBJECT OF THE INVENTION

The general object of my present invention is to extend the aforedescribed principle to a broader class of rapid-transit systems in which the carrier or trains are not necessarily endless conveyors or car chains.

A related object is to provide a system of this nature in which the lateral tracks need not extend alongside the central track between stations but may be limited in length to a relatively short region upstream and downstream of a transfer point at any station.

SUMMARY OF THE INVENTION

In its broadest aspects, my invention can be defined in terms of the system disclosed in my copending application and patent, i.e. with one main or central track flanked by a pair of ancillary tracks respectively used by an express carrier and a pair of shuttle carriers operating in the manner described above.

According to a more specific aspect of my invention, the ancillary tracks are of limited length in the region of each station and the shuttle carriers are reversible to return empty from a transfer point to the loading platform and from the unloading platform to a transfer point, respectively.

Thus, the first ancillary track needs to extend downstream — beyond the transfer point of the loading shuttle — only for a distance sufficient to enable deceleration of this shuttle to standstill, preparatorily to its return to the loading platform; the second ancillary track also needs to extend upstream — beyond the transfer point of the unloading shuttle — only for a distance sufficient to permit acceleration of this shuttle to the speed of the express carrier after having reversed its direction at a location remote from the unloading platform. Since the shuttle carriers will be substantially empty during these deceleration and acceleration phases, the extra track sections beyond the transfer points may be somewhat shorter than those between these points and the respective platforms.

According to another more specific feature of my invention, the carriers — or at least some of them — are provided with freight compartments which in transit are closed against the outside by preferably vertically sliding doors having portions that can be swung outwardly for docking to form bridges with guidetracks and overhead bearing surfaces for roller-mounted freight transporters which, at the instant of transfer, are shifted across these bridges by automatic (preferably pneumatic) means. The transporters may be stabilized within each compartment by an array of coplanar rotating bodies, such as rollers or balls, journaled in the lateral compartment walls.

BRIEF DESCRIPTION OF THE DRAWING

The above and other features of my invention will now be described in detail with reference to the accompanying drawing in which.

SPECIFIC DESCRIPTION

Figure 1:
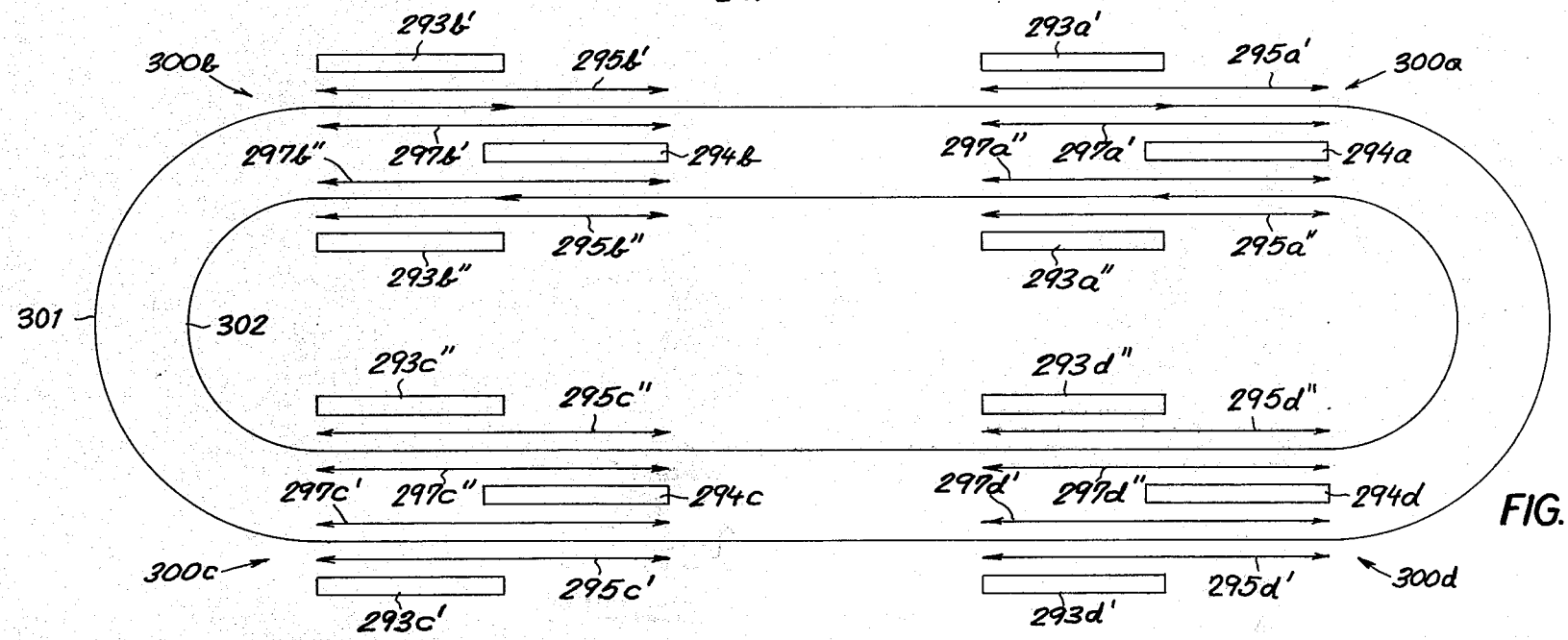
FIG. 1 is an overall diagrammatic plan view showing the layout of a rapid-transit system according to my invention.

In FIG. 1 I have shown a rapid-transit system with two rail lines 301, 302 forming a pair of closed, concentric loops for the purpose of carrying traffic in opposite directions, i.e. clockwise in the case of line 301 and counterclockwise in the case of line 302. The two lines pass a number of stations 300*a*, 300*b*, 300*c*, 300*d* each comprising a loading platform 293*a'*, 293*b'*, 293*c'*29-3*d'* for line 301, an unloading platform 293*a''*, 293*b''*, 293*c''*, 293*d''* for line 302, and a common platform 294*a*, 294*b*, 294*c*, 294*d* serving line 301 for unloading and line 302 for loading.

In accordance with an important feature of my invention, and as more fully described hereinafter with reference to FIG. 2, each line 301 and 302 consists of three adjacent tracks, i.e. a central track 290', 290'' extending over the full length of the loop and a pair of lateral tracks flanking this central track within the area of each station, these lateral tracks having been designated in FIG. 2 for a generic station 300 by references 291', 292' in the case of line 301 and 291'', 292'' in the case of line 302. Express trains 296' circulate continuously on the central track 290' in one direction of transportation, similar trains 296'' moving in the opposite direction on track 290''; these trains have a constant speed V as indicated diamgrammatically in FIG. 2.

The system further includes, at each station 300, two pairs of shuttle trains 295', 297' on tracks 291', 292' and 295'', 297'' on tracks 291'', 292''. All four shuttle trains travel between terminal points A and B at opposite ends of the station, as indicated diagrammatically in FIG. 1 by double-headed arrows 295*a'* – 295*d'*, 295*a''* – 295*d''*, 297*a'* – 297*d'*, 297*a''* *14* 297*d''*. Their motion, as also indicated diagrammatically, accelerates from 0 at terminal points A and B to speed V at intermediate points C and D which they reach simultaneously with a passing express train 296' or 296''.

Shuttle train 295' picks up passengers and goods at point A, at the left-hand end of its loading platform, and then starts up as an express train 296' passes a point E farther upstream. At the same instant, an empty shuttle train 297' also starts from point A with like acceleration. At point C the three trains 295', 296' and 297' are aligned with one another and dock to enable the transfer of departing passengers and goods from train 295' to train 296' and of arriving passengers and goods from train 296' to train 297'. At point D the transfers are completed and the trains undock, train 296' continuing on its way at speed V whereas trains 295' and 297' slow down to come to a stop at point B on the right-hand end of the unloading platform even as the express train 296' passes a point F farther downstream.

For loading and unloading of passengers and goods in the opposite direction, trains 295'' and 297'' start out at point B while a train 296'' passes the point F, then link up with train 296'' at point D, begin their deceleration at point C, and come to a standstill at point A even as train 296'' passes the point E.

Figure 2:
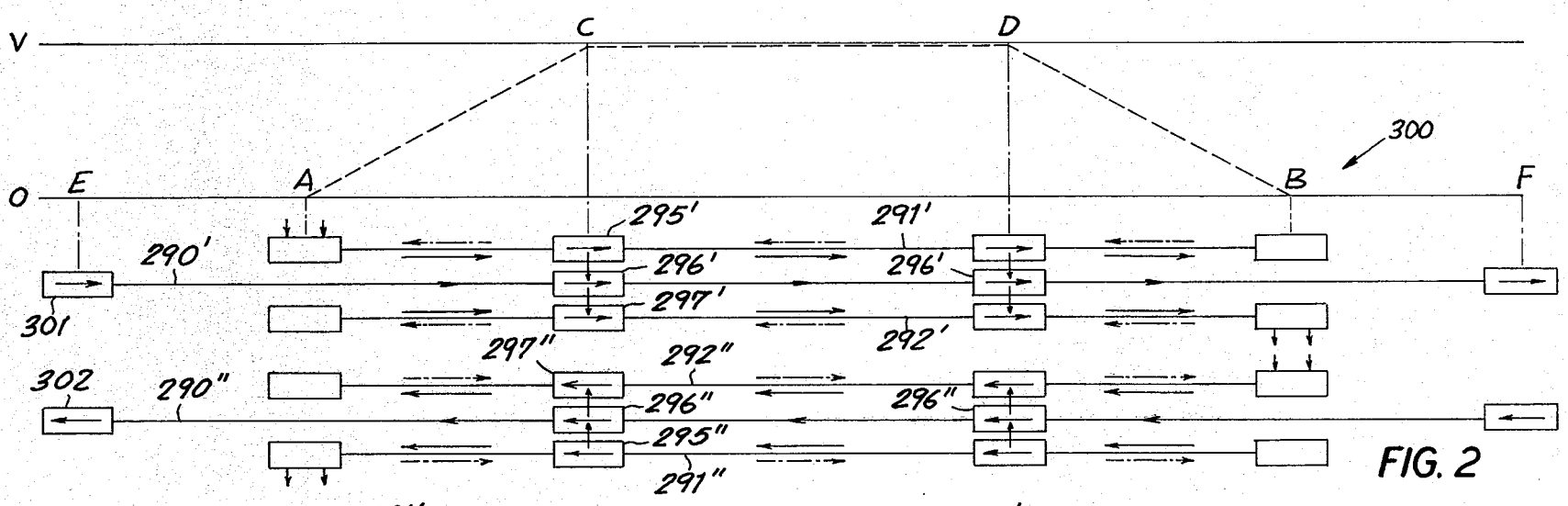
FIG. 2 is a similar diagrammatic view, drawn to a larger scale, showing parts of the system of FIG. 1 in the vicinity of a station.

The working movements of shuttle carriers 295', 297' from terminal A to terminal B (and of shuttle carriers 295'', 297'' from terminal B to terminal A) have been indicated in FIG. 2 by solid arrows; phantom-line arrows indicate the oppositely directed return movements of these carriers, usually without passengers or freight, at any convenient speed not necessarily related to the speed V of the associated express carriers 296' and 296''.

Figure 3:
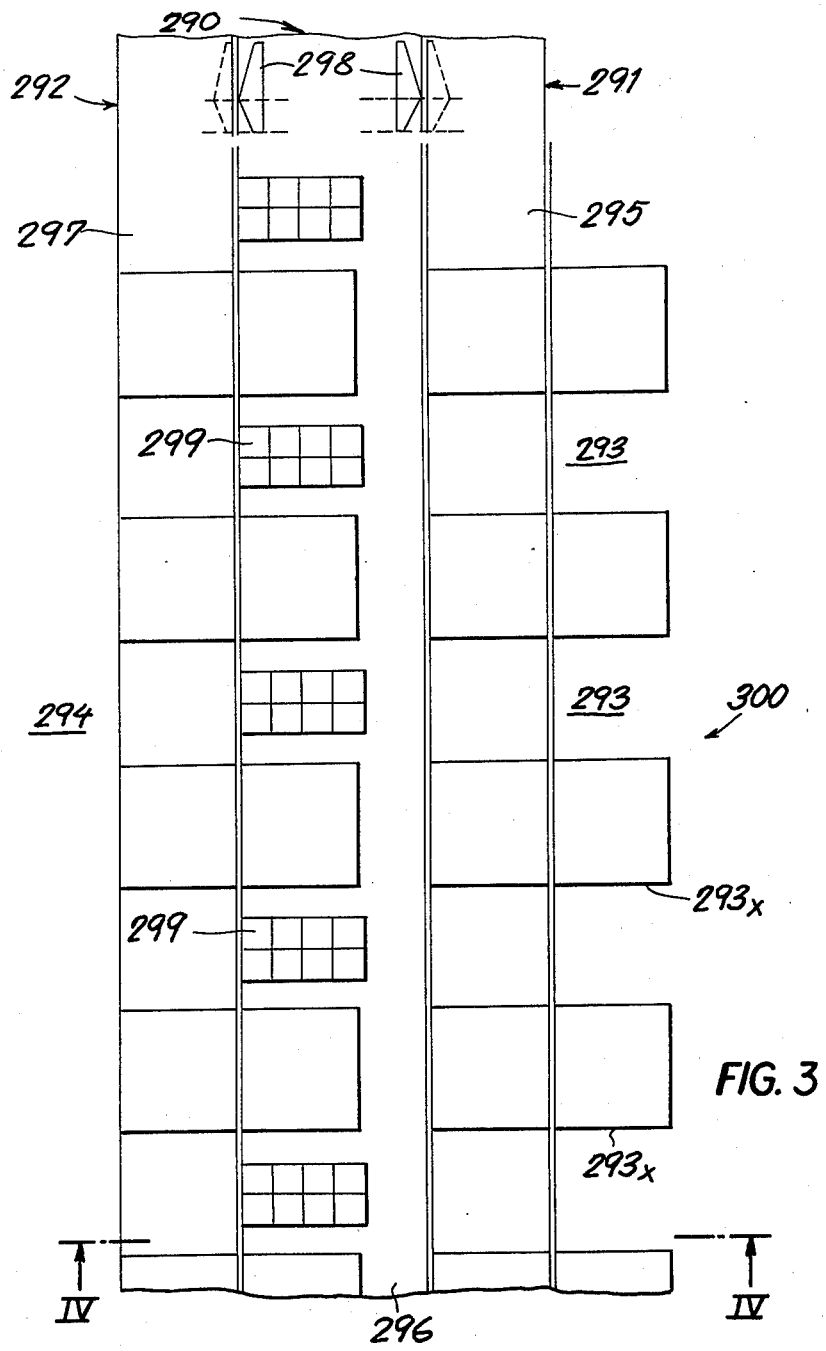
FIG. 3 is a plan view of part of a system with endless carriers as disclosed in my above-identified copending application and patent.
Figure 4:
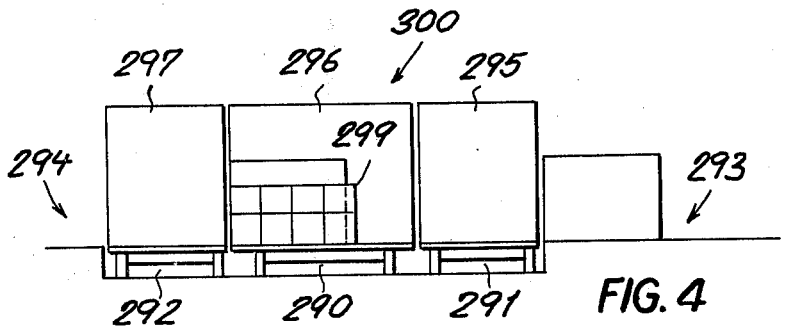
FIG. 4 is a diagrammatic elevation taken on the line IV — IV of FIG. 3.

FIGS. 3 and 4 show part of a station 300, i.e. one half of it serving one direction of transportation, having a loading platform 293 adjacent a track 291 and an unloading platform 294 adjacent track 292. Three endless trains 295 – 297 are shown between these two facing platforms which in this instance need not be staggered in the transport direction. The central train 296 on track 290 travels continuously at high speed, e.g. of approximately 50 km per hour, making a full tour of its loop in 10 to 20 minutes. Each train consists of a chain of cars or conveyor sections.

The loading platform 293 is provided with a plurality of enclosed boarding areas 293*x* having doors which open onto the train 295 when this train stops, thereby letting a group of waiting passengers enter the cars of train 295 whose confronting doors threupon close as the train pulls out of the station and accelerates to the speed of train 296 with which it then docks, door sills 298 on the train 296 linking up with train 295 so that the two trains are locked together with their doors aligned. These doors now open to allow express passengers to transfer from the train 295 to the train 296. The doors thereafter shut, the sils 298 are retracted, and the train 295 slows down to stop at the next station where local riders may disembark while new passengers are taken on.

The express passengers remain on the central train 296 until the other lateral train 297 docks with it in like manner just before the stop at which they intend to get off. As the aligned doors of trains 296 and 297 open, these passengers transfer to the latter train which thereupon closes its doors, slows down and comes to a stop at the unloading platform 294 of the desired station where it opens its outer doors and lets the riders out. If the two shuttle trains 295, 297 are synchronized to dock simultaneously with the continuously moving train 296, local passengers may walk directly across from train 295 to train 297 whereby the need for dishcarging these passengers into the boarding areas 293*x* is avoided.

The mechanical linkage between the cars of the endless trains 295, 296, 297 could also be replaced by computer-controlled switching gear keeping shorter trains or possibly individual cars at a predetermined distance from one another along the track. It is also possible to make the express train continuous and to break up the shuttle trains into shorter sequences of cars.

The shuttle train 295 or 297 may remain stopped for, say, 20 seconds at a station with its doors opening two seconds after it pulls in and closing 2 seconds before it pulls out so that an entry or exit time of 16 seconds is available, more than enough time for ten or twelve passengers in a boarding area to get through the double doors. The acceleration to 50 km/hr may take 10 seconds; the docked trains may then ride together for 20 seconds with their doors opening two seconds after docking and closing 2 seconds before separating. The shuttle train then takes 10 seconds to come to a stop at the next station so that the travel between two adjoining stations may take 40 seconds.

As schematically illustrated, sections 299 of express train 296 may be provided with seats for the passengers.

Figure 5:
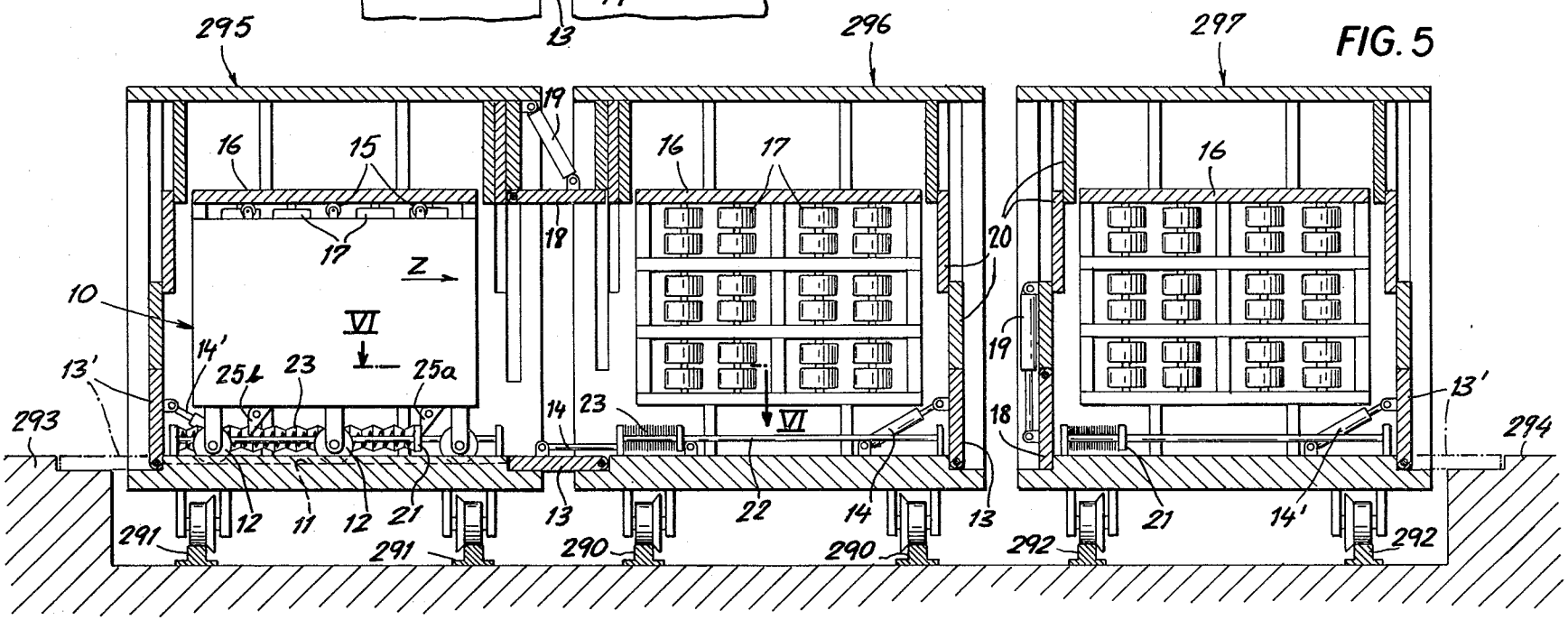
FIG. 5 is a cross-sectional view of three carriers positioned alongside one another at a common transfer point.
Figure 6:
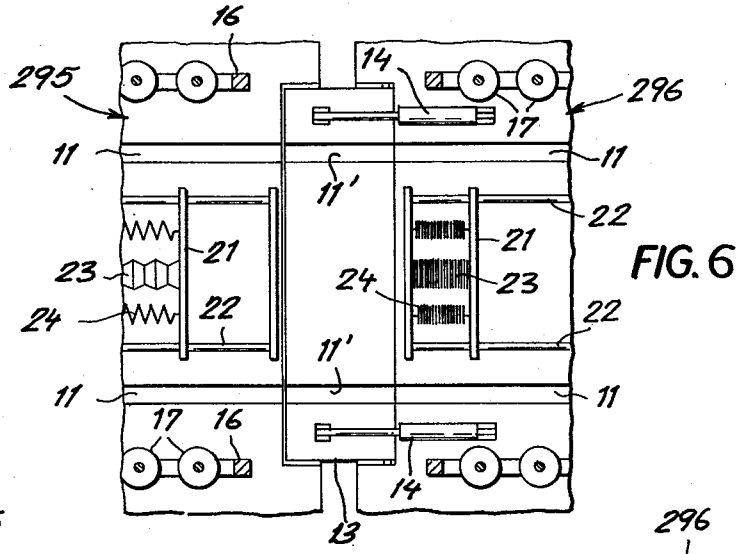
FIG. 6 is a sectional detail view taken on the line VI — VI of FIG. 5.

In FIGS. 5 and 6 I have shown details of carriers 295, 296, 297 riding on respective tracks 291, 290, 292 and forming compartments for wheeled freight transporters 10 in the form of prismatic carriages closed at last on the bottom and the sides. Each compartment has a pair of transverse bottom grooves 11 forming guidetracks for the wheels 12 of the transporters 10; similar grooves 11', in line with grooves 11, are provided on swingable door sections 13 of express carrier 296 which are controlled by jacks 14 holding them in a vertical position when no docking takes place, as illustrated in FIG. 5 for carrier 297 and for the right-hand door of carrier 296. During docking of carriers 295 and 296, for example, the door section 13 between the aligned freight compartments is swung down to form a bridge for a transporter 10 moving across same from left to right, as indicated by an arrow Z in FIG. 5, to pass from the loading shuttle 295 to the express carrier 296; in a similar manner, the transporter 10 can be transferred from carrier 296 to the unloading shuttle 297. Outer wall sections 13' of shuttle carriers 295 and 297, controlled by jacks 14', can be swung out to form a bridge to loading platform 293 or unloading platform 294 when the respective shuttle carrier has come to a halt.

The container bodies of transporters 10 are also provided with upper wheels 15 engaging overhead guide surfaces, formed by plates 16, to help stabilize the transporter in the compartment. For the same purpose, the sidewalls of the compartments are provided with arrays of coplanar rollers 17 bearing upon the sides of the container body to hold it in place.

Shuttle carriers 295 and 297 are also provided with other wall sections 18, controlled by jacks 19, which can be upwardly retracted along with further wall sections 20 (with the aid of nonillustrated hoisting mechanisms) and, upon such retraction, can be swung outwardly into a horizontal position at the level of guide plates 16 to form overhead bearing surfaces for the transporters 10 to stablilize them during transfer from one carrier to the other. The transfer motion is performed or assisted by pushers 21, at the bottom of each compartment, which are guided on rods 22 parallel to grooves 11 and are secured to inflatable bladders 23 adapted to be expanded by a pneumatic fluid from a nonillustrated high-pressure source. Springs 24 tend to maintain the pushers 21 retracted, i.e. near the left-hand entrance ends of the respective compartments, for coaction with pivotable lugs 25*a*, 25*b* at the bottom of the container body which swing out of the way when the container passes over the retracted pusher 21 and which thereafter drop down into a vertical position, suitably backstopped, for entrainment by the pusher upon expansion of its bladder 23. It is thus merely necessary to shove a transporter 10 partly into a freight compartment of carrier 295, across the left-hand bridge 13', and then to expand the bladder 23 thereof for engagement of its pusher 21 with the front lug 25*a* to position the transporter correctly in that compartment. Upon subsequent docking with carrier 296, bladder 23 is deflated until pusher 21 can coact with the rear lug 25 *b* to move the transporter partly into the adjoining compartment of carrier 296; there the same pusher operations are repeated. In like manner the transfer occurs between carriers 296 and 297 preparatorily to unloading, as well as a final thrust to roll the transporter across the right-hand bridge 13' of carrier 297 onto platform 294. Control of the bladders and jacks may be manual or automatic.

Similar transporters could, of course, also be provided for passengers. Thus, sections 299 of FIGS. 3 and 4 could be constituted by mobile conveyances in which the passengers take their seats on loading platform 293 and from which they eventually disembark on unloading platform 294.

Naturally, the construction shown in FIGS. 5 and 6 is equally applicable to endless trains and to carriers of limited length.

I claim:

1. A rapid-transit system comprising:

a plurality of stations each including a loading platform and an unloading platform;

a rail link for said stations including at least one main track passing between said platforms;

a first and a second ancillary track flanking said main track at least in the region of each station;

an express carrier on said main track moving at a substantially constant speed past said stations;

a first shuttle carrier on said first ancillary track for loading said express carrier at a location downstream of the loading platform of a station, said first carrier being accessible from said loading platform and being accelerable from standstill at said loading platform to the speed of said express carrier for pulling alongside same and docking therewith temporarily at said downstream location to facilitate transfer of its load to said express carrier, followed by undocking and deceleration to standstill; and a second shuttle carrier on said second ancillary track for unloading said express carrier at a location upstream of the unloading platform of a station, said second shuttle carrier being accelerable from standstill to the speed of said express carrier for pulling alongside same and docking therewith temporarily at said upstream location to facilitate transfer from said express carrier of some of the load thereof, followed by undocking and deceleration to standstilll at said unloading platform for discharging the transferred load thereat.

2. A rapid-transit system as defined in claim 1 wherein said main track forms a closed loop.

3. A rapid-transit system as defined in claim 2 wherein said shuttle carriers are reversible on said ancillary tracks for reciprocation between respective upstream and downstream terminals, the upstream terminal of one of said ancillary tracks being disposed alongside said loading platform, the downstream terminal of the other of said ancillary tracks being disposed adjacent said unloading platform.

4. A rapid-transit system as defined in claim 3 wherein said loading and unloading platforms of a station are relatively staggered along said main track, said ancillary tracks being substantially coextensive with each other and of sufficient length to enable substantially simultaneous docking of said shuttle carriers with said express carrier along a stretch intermediate said loading and unloading platforms.

5. A rapid-transit system as defined in claim 1 wherein said carriers are provided with freight compartments aligned with one another during docking thereof, said freight compartments being provided with doors retractable for docking, at least some of said doors having sections swingable from one carrier to an adjoining carrier to form bridges for wheeled freight transporters receivable in said compartments.

6. A rapid-transit system as defined in claim 5 wherein said bridges are provided with guidetracks for the wheels of said freight transporters.

7. A rapid-transit system as defined in claim 5 wherein said compartments are provided with upper guide surfaces for said freight transporters, at least some of said doors having other sections swingable from one carrier to an adjoining carrier to form overhead bearing surfaces at the level of said guide surfaces for said freight transporters.

8. A rapid-transit system as defined in claim 5 wherein said compartments have lateral walls provided with arrays of coplanar rotating bodies engageable with said freight transporters for stabilizing same.

9. A rapid-transit system as defined in claim 5 wherein said compartments are provided with fluid-actuated thrust means for transferring said freight transporters from one carrier to an adjoining carrier.

10. A rapid-transit system comprising:

a rail line with three parallel tracks including a central track and two lateral tracks;

a continuously running passenger carrier on said central track;

a pair of intermittently moving shuttle carriers on said lateral tracks; and several stations each forming a loading platform alongside one of said lateral tracks and an unloading platform alongside the other of said lateral tracks, said unloading platform lying downstream of said loading platform in the direction of movement of said passenger carrier;

said loading platform giving access to one shuttle carrier upon a halting thereof at the station for boarding by waiting passengers, said unloading platform being accessible to arriving pasengers on the other shuttle carrier upon a halting of the latter at the station, said shuttle carrier being accelerable to the speed of said continuously running carrier and being provided with docking means for temporarily and substantially simultaneously locking onto said continuously running carrier along a stretch located intermediate said loading and unloading platforms to facilitate the transfer of passengers therebetween.

* * * * *